US008523663B2

(12) United States Patent
Gagner et al.

(10) Patent No.: US 8,523,663 B2
(45) Date of Patent: Sep. 3, 2013

(54) TRANSPORTING AND USING WAGERING GAME DATA

(75) Inventors: Mark B. Gagner, West Chicago, IL (US); Nevin J. Liber, Libertyville, IL (US); Larry J. Pacey, Northbrook, IL (US); Craig J. Sylla, Round Lake, IL (US); Alfred Thomas, Las Vegas, NV (US)

(73) Assignee: WMS Gaming, Inc, Waukegan, IL (US)

( * ) Notice: Subject to any disclaimer, the term of this patent is extended or adjusted under 35 U.S.C. 154(b) by 131 days.

(21) Appl. No.: 13/145,270

(22) PCT Filed: Jan. 18, 2010

(86) PCT No.: PCT/US2010/021318

§ 371 (c)(1),
(2), (4) Date: Oct. 10, 2011

(87) PCT Pub. No.: WO2010/083486

PCT Pub. Date: Jul. 22, 2010

(65) Prior Publication Data

US 2012/0028714 A1 Feb. 2, 2012

Related U.S. Application Data

(60) Provisional application No. 61/145,648, filed on Jan. 19, 2009.

(51) Int. Cl.
*G07F 17/32* (2006.01)

(52) U.S. Cl.
USPC ..... 463/25; 463/16; 463/20; 463/29

(58) Field of Classification Search
USPC ..... 463/16, 20, 25, 2, 9
See application file for complete search history.

(56) References Cited

U.S. PATENT DOCUMENTS

| | | | | |
|---|---|---|---|---|
| 7,753,797 | B2 * | 7/2010 | Walker et al. | 463/43 |
| 2006/0258096 | A1 | 11/2006 | Noble et al. | |
| 2006/0287109 | A1 | 12/2006 | Mercado et al. | |
| 2007/0155490 | A1 | 7/2007 | Phillips et al. | |
| 2008/0009344 | A1 | 1/2008 | Graham et al. | |
| 2008/0102956 | A1 | 5/2008 | Burman et al. | |
| 2012/0028714 | A1 | 2/2012 | Gagner et al. | |

FOREIGN PATENT DOCUMENTS

| | | |
|---|---|---|
| JP | 2005216261 | 8/2005 |
| JP | 2005334201 | 12/2005 |

OTHER PUBLICATIONS

"PCT Application No. PCT/US10/21318 International Preliminary Report on Patentability", Apr. 13, 2011 , 12 pages.

(Continued)

*Primary Examiner* — Omkar Deodhar
(74) *Attorney, Agent, or Firm* — DeLizio Gilliam, PLLC

(57) ABSTRACT

A wagering game system and its operations are described herein. In embodiments, the operations can include determining a connection of a portable wagering game player drive to a wagering game network. The operations can include determining a player preference regarding a focus of data to store and storing player experience data from the wagering game network according to the player preference. The operations can further include determining a request to disconnect the portable wagering game player drive from the wagering game network, securing the player experience data for transfer beyond the wagering game network; and presenting wagering game content using a computing device outside of the wagering game network using at least some of the player experience data from the portable wagering game player drive.

33 Claims, 8 Drawing Sheets

(56) References Cited

OTHER PUBLICATIONS

"PCT Application No. PCT/US10/21318 International Search Report", Mar. 24, 2010 , 9 pages.

Beckett, Jamie , "Demystifying the memristor: Proof of fourth basic circuit element could transform computing", http://www.hpl.hp.com/news/2008/apr-jun/memristor.html Apr. 2008.

Williams, R. Stanley , "How We Found the Missing Memristor",.

* cited by examiner

TRANSPORTING AND USING WAGERING GAME DATA

RELATED APPLICATIONS

This application claims the priority benefit of U.S. Provisional Application Ser. No. 61/145,648 filed Jan. 19, 2009.

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2010, WMS Gaming, Inc.

TECHNICAL FIELD

Embodiments of the inventive subject matter relate generally to wagering game systems and networks that, more particularly, transport and use wagering game data.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

SUMMARY

In some embodiments, one or more machine-readable media having stored thereon instructions which when executed by a set of one or more processors causes the set of one or more processors to perform operations comprises: storing wagering game content from a wagering game network onto a portable wagering game player drive; disconnecting the portable wagering game player drive from the wagering game network; connecting the portable wagering game player drive to a computing device that is not connected to the wagering game network, wherein the computing device is capable of processing the wagering game content; determining a selection of the wagering game content on the computing device; initiating a wagering game session on the computing device; presenting the wagering game content using the computing device during the wagering game session; and storing wagering game session data on the portable wagering game player drive.

In some embodiments, the operation of storing wagering game content comprises operations for storing a wagering game library of a wagering game provider on the portable wagering game player drive, and presenting the wagering game content from the wagering game library.

In some embodiments, the operations further comprise configuring the computing device to secure the wagering game content; and assigning the computing device to a wagering game player.

In some embodiments, the operations further comprise using environmental data stored on the portable wagering game player drive to emulate a gambling environment on playback mechanisms connected to the computing device.

In some embodiments, the operations further comprise storing player preference data on the portable wagering game player drive; determining that the wagering game session is terminated; securing the wagering game session data and the player preference data on the portable wagering game player drive; connecting to the wagering game network; initiating an additional wagering game session; accessing the player preference data on the portable wagering game player drive; and customizing a presentation of the additional wagering game session based on the player preference data.

In some embodiments, the operations further comprise determining that the wagering game session is terminated; securing the wagering game session data on the portable wagering game player drive; connecting to the wagering game network; providing the wagering game session data to one or more devices on the wagering game network; predicting a player's personal preference on the wagering game network using the wagering game session data; and tailoring an additional wagering game session to the player's personal preference.

In some embodiments, the operations further comprise determining a geographic location of the computing device; determining that the computing device is located within an authorized gambling jurisdiction associated with the geographic location; and authorizing the wagering game session.

In some embodiments, a method comprises determining a connection of a portable wagering game player drive to a wagering game network; determining a player preference regarding a focus of data to store; storing player experience data from the wagering game network according to the player preference; determining a request to disconnect the portable wagering game player drive from the wagering game network; securing the player experience data for transfer beyond the wagering game network; and preparing the player experience data for presentation in conjunction with wagering game content on a computing device outside of the wagering game network using at least some of the player experience data from the portable wagering game player drive.

In some embodiments, the player preference relates to a priority for storing types of recordable data available on the wagering game network.

In some embodiments, the player experience data relates to one or more of player data, wagering game data, environmental data, account data, game settings, game configurations, and player preferences.

In some embodiments, the method further comprises determining pre-configured player preference data on the portable wagering game player drive; and customizing presentation of the wagering game content in a wagering game session on the wagering game network using the pre-configured player preference data.

In some embodiments, the pre-configured player preference data relates to one or more of a player preferred game theme, a background graphic, a game setting, a control configuration, a display option, a sound settings, a multi-media file, account information, social contact information, communication settings, identification information, contact information, competition game settings, and group configuration settings.

In some embodiments, the method further comprises authorizing the connection to the wagering game network; and preparing the portable wagering game player drive to store the player experience data from the wagering game network.

In some embodiments, storing the player experience data from the wagering game network according to the player preference further comprises determining one or more recording devices associated with the portable wagering game player drive; recording one or more of audio and visual data within recording range of the one or more recording devices; and presenting the one or more of audio and visual data on playback equipment associated with the computing device.

In some embodiments, a system comprises a wagering game network device that comprises a content controller configured to provide portable data on a wagering game network, wherein the portable data comprises one or more of wagering game content, environmental data, player data, and account data. The system can also include a portable storage device comprising an ultra-high density memory configured to store the portable data, a storage controller configured to store and categorize the portable data on the ultra-high density memory, and a security module configured to secure the portable data to be transportable from the wagering game network and usable external to the wagering game network.

In some embodiments, the system further comprises an account server including an account controller configured to control information for a player's account, an account store configured to store information for the player's account, and a player preferences store configured to store player preferences for settings regarding priority preferences for recording types of data on the wagering game network.

In some embodiments, the portable storage device further comprises a data recording controller configured to record, on the portable storage device, environmental data from recording devices within the wagering game network, and provide the environmental data to playback mechanisms to play recordings of gambling environment information.

In some embodiments, the system further comprises a home-based computing device configured to initiate a wagering game session, present the portable data using during the wagering game session, and store wagering game session data on the portable storage device.

In some embodiments, the system further comprises a wagering game server comprises a synchronization unit configured to synchronize the wagering game session data with wagering game network data.

In some embodiments, an apparatus comprises a portable data module configured to store wagering game content and account data on a portable wagering game player drive when connected to a wagering game network, deduct a portable gaming session amount from a wagering game account, disconnect the portable wagering game player drive from the wagering game network, and determine that the portable wagering game player drive is connected to a computing device external to the wagering game network and capable of processing the wagering game content and the account data. The portable data module can also begin a secure portable wagering game session with the computing device using the account data, set a session wagering limit equivalent to the portable gaming session amount, access the portable gaming session amount for wagers during the portable wagering game session, and store portable wagering game session data on the portable wagering game player drive.

In some embodiments, the portable data module is further configured to terminate the portable wagering game session, determine that the portable wagering game player drive has reconnected to the wagering game network, and synchronize the portable wagering game session data with wagering game account data on an account server.

In some embodiments, the portable data module is further configured to set a beginning portable wagering game session account balance equal to the account balance, modify the portable wagering game session account balance with one or more of wagers and wins obtained during the portable wagering game session, and store the portable wagering game session account balance on the portable wagering game player drive.

In some embodiments, an apparatus comprises means for determining a connection of a portable wagering game player drive to a wagering game network; means for determining pre-configured player preference data on the portable wagering game player drive; means for customizing presentation of wagering game content in a wagering game session using the pre-configured player preference data; means for storing wagering game data from the wagering game network on the portable wagering game player drive; means for disconnecting the portable wagering game player drive from the wagering game network; and means for presenting an additional wagering game session outside of the wagering game network using at least some of the wagering game data from the portable wagering game player drive.

In some embodiments, the means for presenting the wagering game session outside of the wagering game network further comprises: means for initiating the additional wagering game session on a computing device capable of processing the wagering game data; and means for storing additional wagering game data on the portable wagering game player drive during the additional wagering game session.

In some embodiments, the means for presenting the additional wagering game session comprises means for presenting the additional wagering game session on an additional wagering game network.

BRIEF DESCRIPTION OF THE DRAWING(S)

Embodiments are illustrated in the Figures of the accompanying drawings in which.

DESCRIPTION OF ILLUSTRATIVE EMBODIMENTS

This description of the embodiments is divided into five sections. The first section provides an introduction to embodiments. The second section describes example operating environments while the third section describes example operations performed by some embodiments. The fourth section describes additional example operating environments while the fifth section presents some general comments.

Introduction

This section provides an introduction to some embodiments.

Casinos are careful to protect sensitive data from leaving the boundaries of casinos. Many of the mobile devices utilized in a casino are designed with extreme security precautions, to the point of self-destruction if the devices are removed from casino boundaries. Further, many of those mobile devices are very limited in the amount of actual data they contain to prevent data tampering and theft. Mobile devices also have low memory capacity because of their size and therefore have to communicate constantly with a server, increasing resource usage on the mobile device. However, some embodiments of the inventive subject matter present portable, secure, and ultra-high-density memory devices that a player can utilize to securely transport nearly unlimited amounts of data, even sensitive data, from a casino and use the data in other locations, on other systems, etc. For example, FIG. 1 shows how a wagering game system 100 can store wagering game data and other information available within a wagering game network on a portable player drive 140 and transport the data beyond a wagering game network to use elsewhere.

Figure 1:
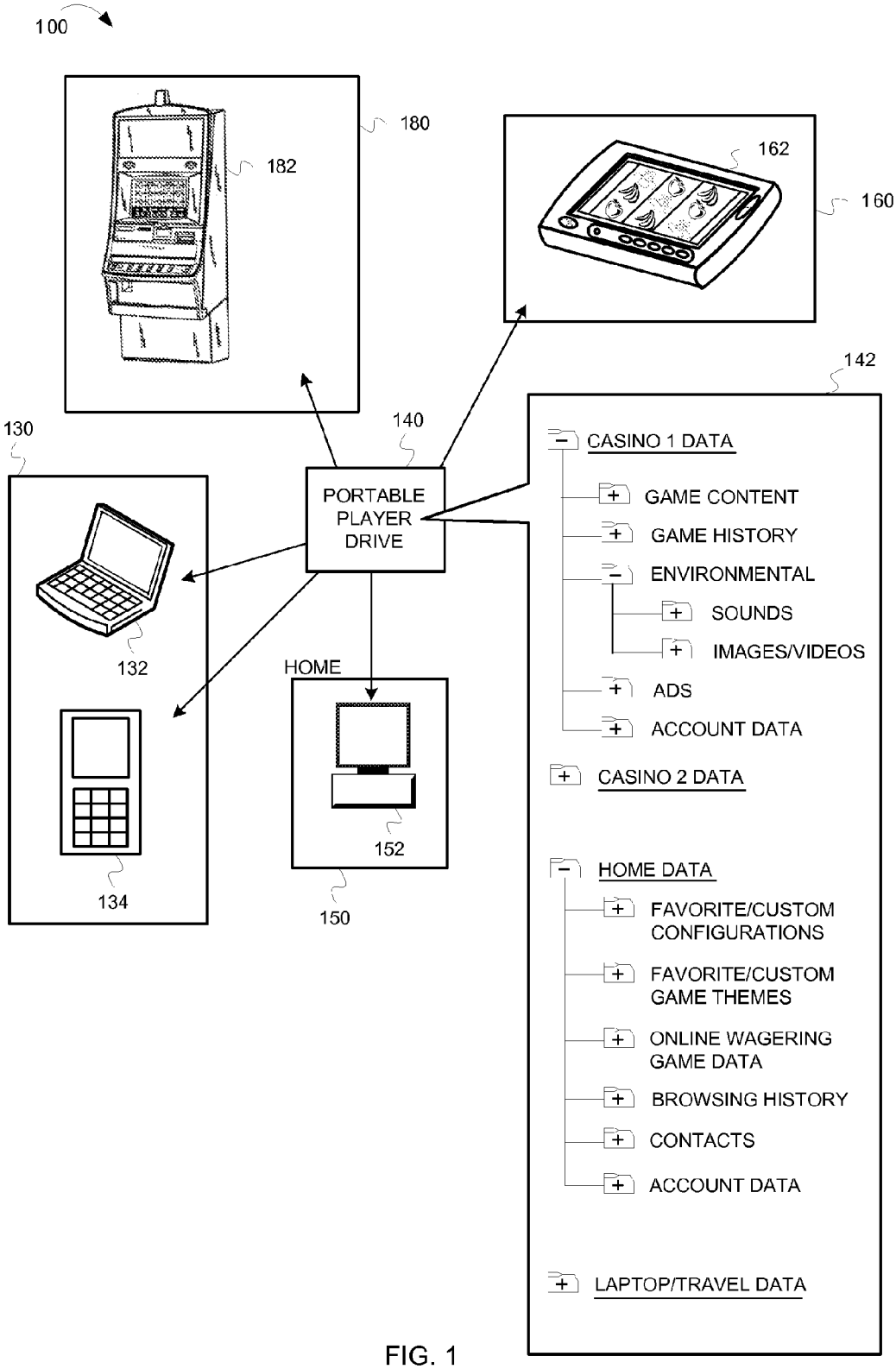
FIG. 1 is an illustration of storing portable data for use on multiple networks and devices, according to some embodiments.

FIG. 1 is a conceptual diagram that illustrates an example of storing portable data for use on multiple networks and devices, according to some embodiments. In FIG. 1, the wagering game system ("system") 100 includes a portable player drive 140 that can store, game data, player data, account data, environmental data, advertisement data, and all other types of data connected with a wagering game experience. The system 100 can also include devices 182, 162, 132, 134, 152 from various locations 180, 160, 130 and 150. The devices 182, 162, 132, 134, 152 are capable of providing wagering game content in connection with a wagering game session in any of the locations 180, 160, 130 and 150. The portable player drive 140 is configured with vast amounts of storage space on a small, portable device. The portable player drive 140 can be configured to connect to, and communicate, with the devices 182, 162, 132, 134, 152 directly (e.g., via a "wired" connection, via an input/output port, etc.), wirelessly (e.g., Bluetooth™ communications, radio frequency communications, infra-red communications), via a network (e.g., via the communications network 122), or in other ways. The portable player drive 140 can connect to wagering game machines within a wagering game network (e.g., a wagering game machine 182 in a first wagering game network 180 or a wagering game machine 162 in a second wagering game network 160). The portable player drive 140 can also connect to other computing devices external to a wagering game network (e.g. a personal computer 152 in a home 150, portable computing devices, such as a laptop 132 or a mobile phone 134, in one or more in-transit locations 130). A casino patron can carry the portable player drive 140 between the various locations 180, 160, 130 and 150 and connect the portable player drive to the devices 182, 162, 132, 134, 152. The wagering game machines 182, 162, the personal computer 152 and the portable computing devices 131, 134 are configured to process read, store and/or modify information on the portable player drive 140. The portable player drive 140 can include a file system 142 that tracks all types of data for the various devices and locations that the portable player drive can connect to. The portable player drive 140 can store all types of data available from the locations 180, 160, 130 and 150. For example the portable player drive 140 can access and store data from the devices 152, 132, 134, 182, 162, from network devices associated with the locations 180, 160, 130, 150, from recording devices within the locations 180, 160, 130 and 150 (e.g., video recording equipment, sound recording equipment, televisions, digital video recorders, music recording equipment), from recording equipment on the portable player drive 140, etc. In some embodiments, the personal computer 152, the laptop 132, and the mobile phone 134 can be connected to networks (e.g., peer-to-peer networks, local area networks, wide area networks, cell phone networks, etc.). In other embodiments, however, the personal computer 152, the laptop 132, and the mobile phone 134 do not have to be a part of a network but can still be configured to store data on, and use data from, the portable player drive 140. Some types of data that the portable player drive 140 may store may include, but not be limited to, favorite game configurations, website data, web-browsing history, online game data, portable wagering game session data (e.g., account data from a portable wagering game session), personal contacts, emails, documents, pictures, music files, television shows, movies, etc. The personal computer 152 can be connected to audio and visual recording equipment, which can record sounds and images within a player's home and store them on the portable player drive 140. The personal computer 152 can also use data stored on the portable player drive 140 that is from casinos (e.g., the first casino network 180 and the second casino network 160). For instance, a player can play a wagering game on the personal computer 152 and can use game history, environmental data, sounds and images, advertisements, etc. that were stored on the portable player drive 140 while within the first wagering game network 180 or the second wagering game network 160. The personal computer 152 can use the casino data stored on the portable player drive 140 to enhance a wagering game session played on the personal computer (e.g., to provide content that can present a reproduction of a wagering environment, to provide game history data to replay wagering games that were played on the wagering game networks 180, 160, to provide game content for wagering games that normally would only be available on the wagering game machines 182, 162, etc.). Some data that can be stored on the portable player drive 140 can be captured by devices under the control of a casino, while other devices may be under the control of the player (e.g., recording devices on the portable player drive 140). The casino may indicate what type of casino-controlled data can or cannot be recorded to the portable player drive 140 from casino devices. Therefore, all data that can be stored on the player drive, either by permission of a casino and/or under the control of the player, may be referred to herein as "portable" data, because it can be stored, transported, and used between, and beyond, wagering game networks. Further, the data that can be stored on the portable player drive 140 may also be referred to as "player experience data", as it includes data regarding a player's experiences during wagering game sessions (whether inside or outside a casino, such as in a player's home), or while experiencing sights, sounds, and activities associated with wagering games and wagering game environments.

Although FIG. 1 describes some embodiments, the following sections describe many other features and embodiments.

Example Operating Environments

This section describes example operating environments and networks and presents structural aspects of some embodiments. More specifically, this section includes discussion about wagering game system architectures.

Wagering Game System Architecture

Figure 2:
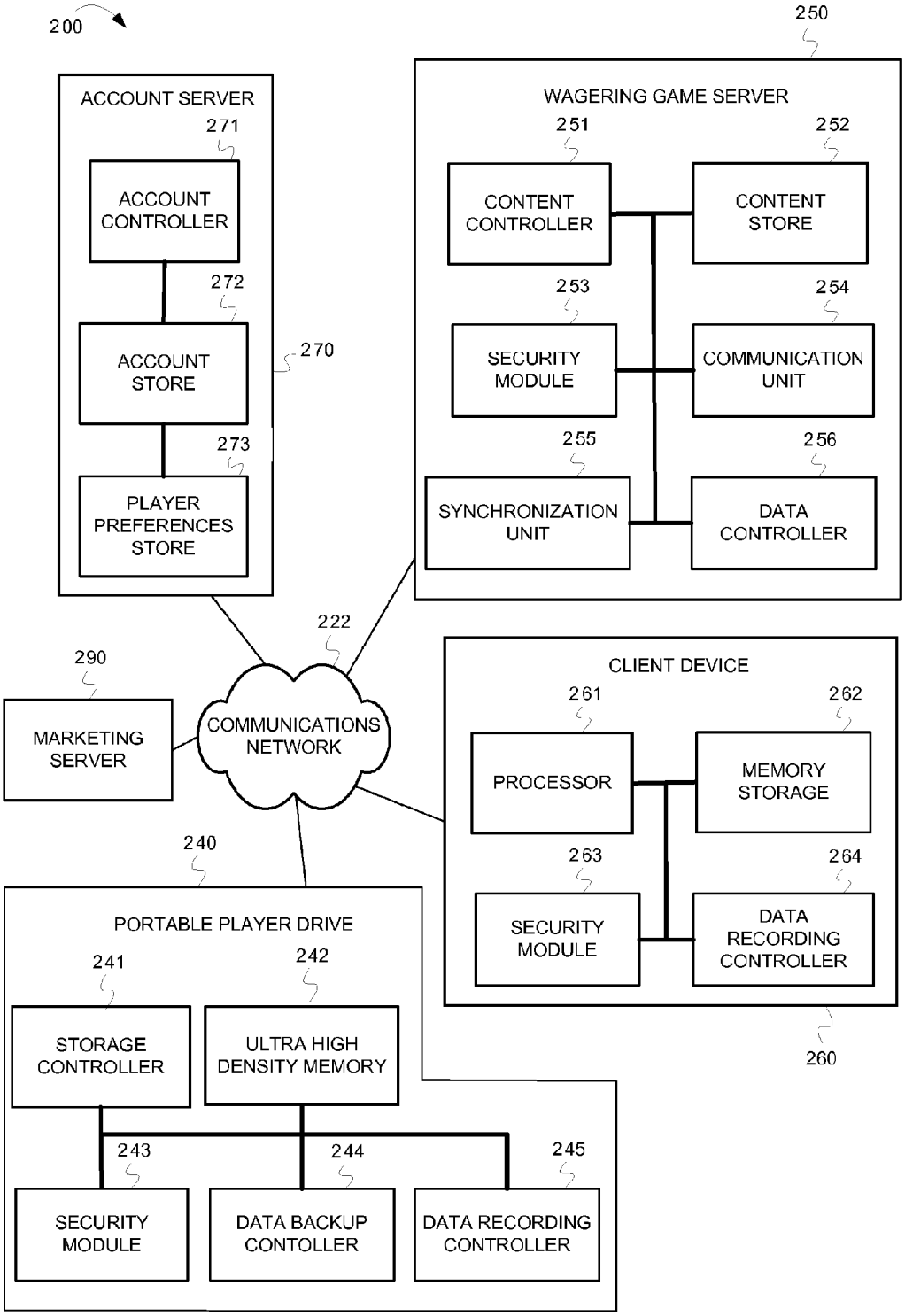
FIG. 2 is an illustration of a wagering game system architecture 200, according to some embodiments.

FIG. 2 is a conceptual diagram that illustrates an example of a wagering game system architecture 200, according to some embodiments. The wagering game system architecture 200 can include an account server 270 configured to control user related accounts accessible via wagering game networks and social networks. A portable player drive 240 can store and track player information, such as identifying information (e.g., avatars, screen name, account identification numbers, etc.) or other information like financial account information, social contact information, etc. The portable player drive 240 can contain accounts for social contacts referenced by the player account. The portable player drive 240 can also provide auditing capabilities, according to regulatory rules, and track the performance of players, machines, and servers. The account server 270 can include an account controller 271 configured to control information for a player's account. The account server 270 can also include an account store 272 configured to store information for a player's account. The account server 270 can also include a player preferences store 273 configured to store player preferences for settings regarding storage and use of portable, wagering-game-related data from various locations (e.g., in casinos, at home, on travel, etc.).

The wagering game system architecture 200 can also include a wagering game server 250 configured to control wagering game content, provide random numbers, and communicate wagering game information, account information, and other information to and from a client device 260. The wagering game server 250 can include a content controller 251 configured to manage and control content for the presentation of content on the client device 260. For example, the content controller 251 can generate game results (e.g., win/loss values), including win amounts, for games played on the client device 260. The content controller 251 can communicate the game results to the client device 260. The content controller 251 can also generate random numbers and provide them to the client device 260 so that the client device 260 can generate game results. The wagering game server 250 can also include a content store 252 configured to contain content to present on the client device 260. The wagering game server 250 can also include a security module 253 configured to authorize access by portable player drives to a wagering game network. The security module 253 can also authorize and/or prepare stored portable data for use on the wagering game network. Further, the security module 253 can also secure and prepare the storage of portable data for use on other networks. The wagering game server 250 can also include a communication unit 254 configured to communicate information to the client device 260 and to communicate with other systems, devices and networks. The wagering game server 250 can also include a synchronization unit 255 configured to synchronize portable player data obtained from the portable player drive 240 with data from accounts and data sources stored on a wagering game network. The wagering game server 250 can also include a data controller 256 configured to receive portable player data provided by the portable player drive 240. The data controller 256 can also provide data requested by, or for, the portable player drive 240. The data controller 256 can provide the portable player data to devices on a wagering game network, such as the client device 260, marketing server 290, the account server 270, game coordination/scheduling servers, network game servers, etc. The data controller 256 can also convert portable data into different file formats, modify portable player data, and reuse data to reenact wagering games, or other events and activities, stored on the portable player drive 240.

The wagering game system architecture 200 can also include the client device 260 configured to present and control wagering game content, interface with the portable player drive 240 and control the recording and use of portable player data. The client device 260 can include a processor 261 configured to process content and instructions on the client device 260. The client device 260 can also include a memory storage 262 configured to store content and other information needed to process wagering games and/or to store portable player data on the portable player drive 240. The client device 260 can also include a security module 263 configured to secure stored portable player data including sensitive wagering game data, financial account data, personal identification data, etc. The security module 260 can provide security measures (e.g., encrypted data, encrypted hard drives, etc.) that provide protection to a portable device (e.g., a mobile wagering game machine). The client device 260 can also include a data recording controller 264 configured to record portable player data including game data, environmental data, personal data, account data, etc. The data recording controller 264 can interoperate with applications stored in the memory storage 262 and/or with hardware devices integrated into the client device 260 to collect data to store on the portable player drive 240.

The wagering game system architecture 200 can also include the portable player drive 240 configured to store and transport wagering game data, environmental data, player preferences, account data, and other information related to wagering game sessions. The portable player drive 240 can include a storage controller 241 configured to control the storage and categorization of portable player data based on location stored, type of information, network access, etc. The portable player drive 240 can also include an ultra-high density memory 242 configured to store vast amounts of portable player data. For instance, in some embodiments, the ultra-high density memory 242 can include a memristor enabled storage devices and other such mechanisms. One example of a memristor enabled storage device is a cross-bar array of nanometer-sized titanium dioxide switches (e.g., platinum electrodes, dual layer TiO2 switch material, etc.). The cross-bar switch array can have layers upon layers of stacked cross-bar switches creating an extremely high density of memory bits, approximately 1000+ times greater than conventional transistor memory devices. Other examples of ultra-high density storage devices can include phase-change diode memory devices, nanodot enabled storage devices, nanotube enabled storage devices, nano-RAM, nanowire enabled storage devices, micro-electric-mechanical-system probe storage devices, etc. In some embodiments, the ultra-high density memory 242 can be a non-volatile memory device (e.g., to maintain memory storage, and be transportable, without needing a power source during transfer). The portable player drive 240 can also include a security module 243 configured to secure portable player data so that it can be transported from a casino and connected to external networks and devices. The security module 243 can also store and/or provide keys, passwords, or other security mechanisms that devices can utilize to access and use the portable player data. The portable player drive 240 can also include a data backup controller 244 configured to backup portable game data when connected to backup devices. The portable player drive 240 can also include a data recording controller 245 configured to interface and record data from devices connected to the portable player drive, the client device 260, and/or any other device connected to a communications network 222, including audio/visual equipment available in a casino and/or in a home network.

Each component shown in the wagering game system architecture 200 is shown as a separate and distinct element connected via the communications network 222. However, some functions performed by one component could be performed by other components. For example, the wagering game server 250 can also be configured to perform functions of the account server 270, the marketing server 290, and other network elements and/or system devices. Furthermore, the components shown may all be contained in one device, but some, or all, may be included in, or performed by multiple devices, as in the configurations shown in FIG. 2 or other configurations not shown. For example, the communication unit 254 can be included in the client device 260 instead of, or in addition to, being a part of the wagering game server 250. Further, in some embodiments, the client device 260 can determine wagering game outcomes, generate random numbers, etc. instead of, or in addition to, the wagering game server 250.

In some embodiments, some client devices, such as wagering game machines, work together with wagering game servers as thin, thick, or intermediate clients. For example, one or more elements of game play may be controlled by wagering game machines (client) or the wagering game servers (server). Game play elements can include executable game code, lookup tables, configuration files, game outcome, audio or visual representations of the game, game assets or the like. In a thin-client example, the wagering game server can perform functions such as determining game outcome or managing assets, while the wagering game machines can present a graphical representation of such outcome or asset modification to the user (e.g., player). In a thick-client example, the wagering game machines can determine game outcomes and communicate the outcomes to the wagering game server for recording or managing a player's account.

In some embodiments, either the wagering game machines (client) or the wagering game server(s) can provide functionality that is not directly related to game play. For example, account transactions and account rules may be managed centrally (e.g., by the wagering game server(s)) or locally (e.g., by the wagering game machines). Other functionality not directly related to game play may include power management, presentation of advertising, software or firmware updates, system quality or security checks, etc.

Furthermore, the wagering game system architecture 200 can be implemented as software, hardware, any combination thereof, or other forms of embodiments not listed. For example, any of the network components (e.g., the wagering game machines, servers, etc.) can include hardware and machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram. Furthermore, in some embodiments, a portable player drive can work in concert with other devices to perform some, or all, of the operations described below.

Figure 3:
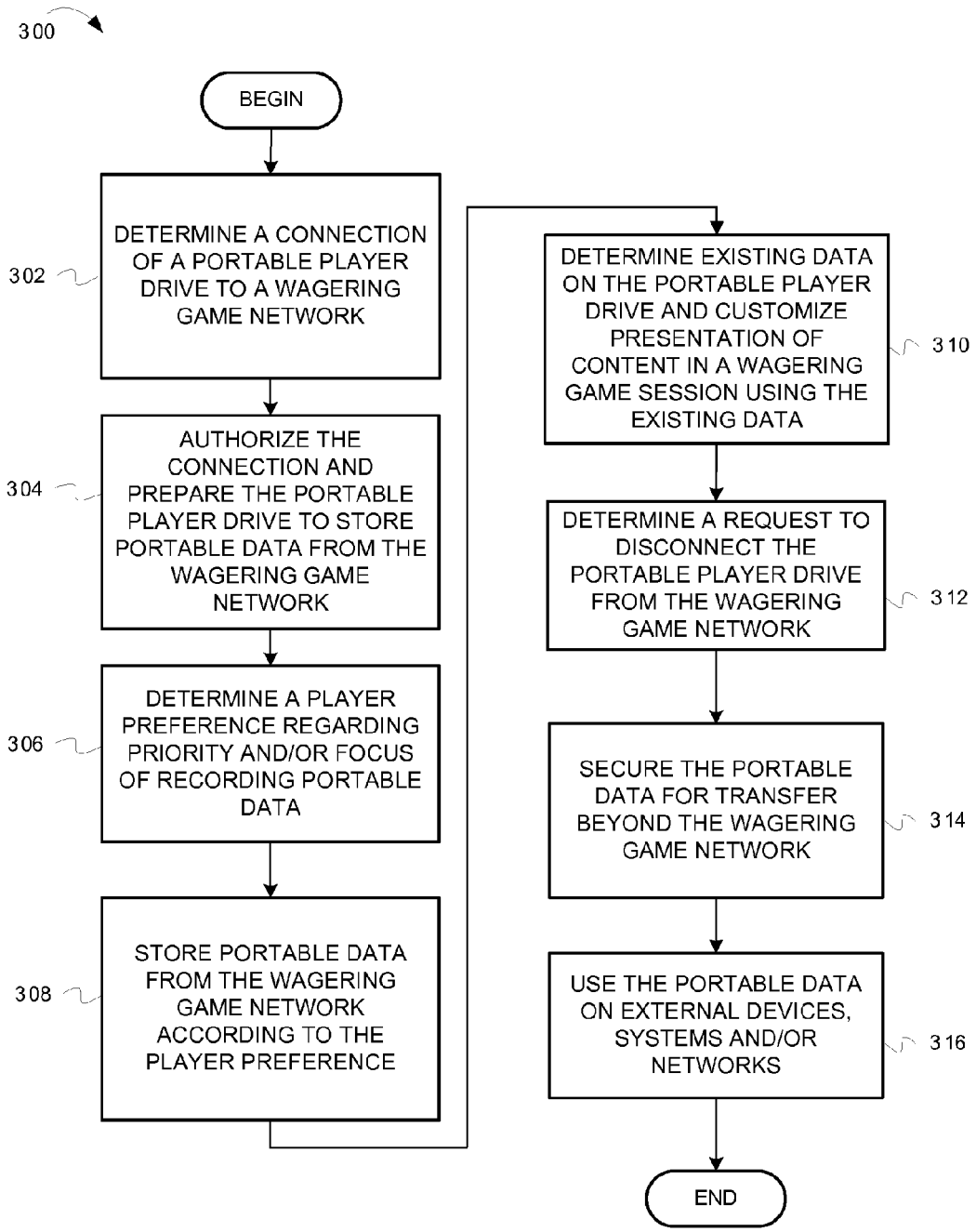
FIG. 3 is a flow diagram illustrating storing portable data for use external to a wagering game network, according to some embodiments.
Figure 6:
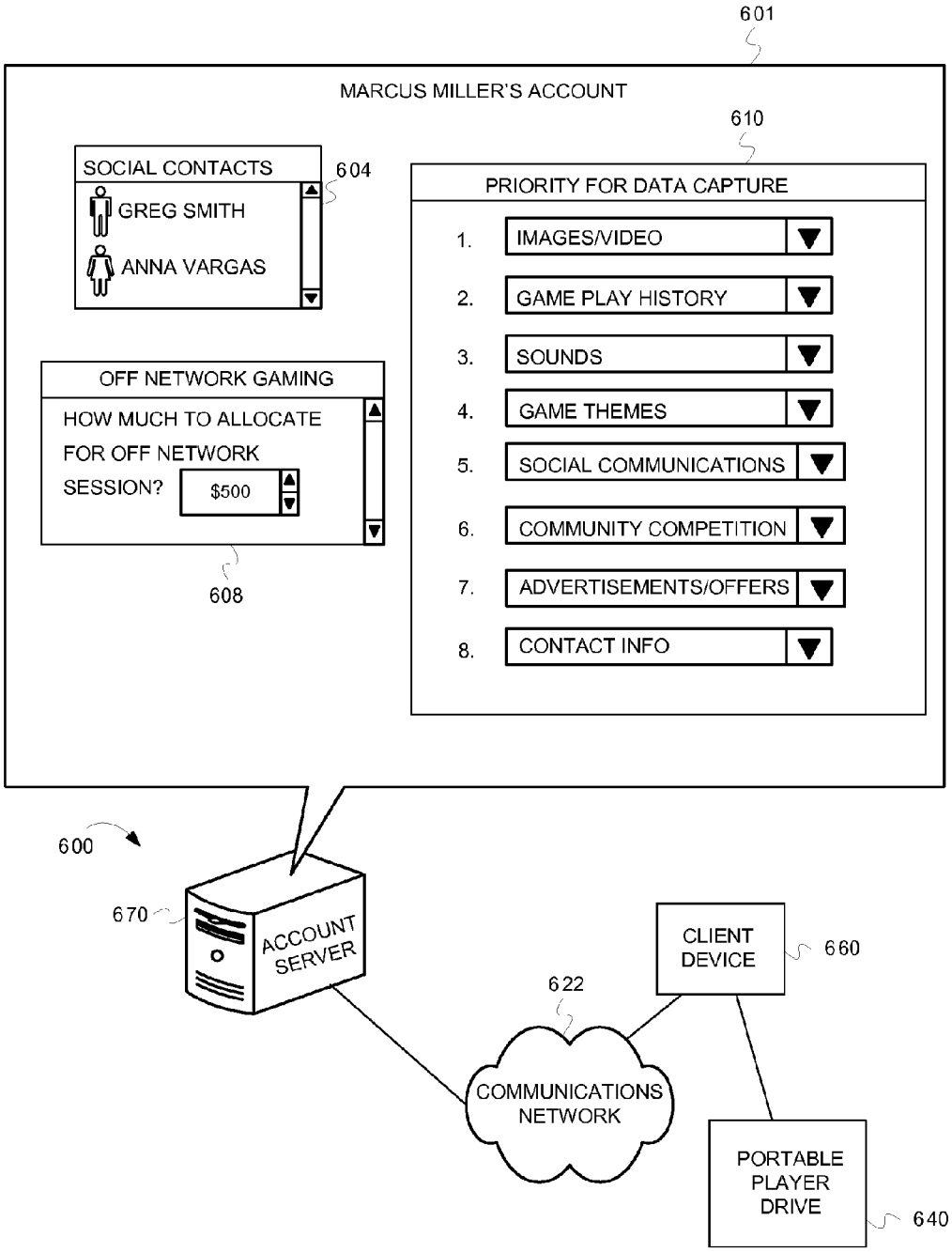
FIG. 6 is an illustration of a wagering game system 600, according to some embodiments.

FIG. 3 is a flow diagram ("flow") 300 illustrating storing portable data for use external to a wagering game network, according to some embodiments. FIGS. 1 and 6 are conceptual diagrams that help illustrate the flow of FIG. 3, according to some embodiments. This description will present FIG. 3 in concert with FIGS. 1 and 6. In FIG. 3, the flow 300 begins at processing block 302, where a wagering game system ("system") determines a connection of a portable wagering game player drive ("portable player drive") to a wagering game network. While in a casino, the portable player drive can connect to wireless and wired networks and devices. For example, the portable player drive may have its own wireless communication unit that can connect to a wagering game network wirelessly when it is in wireless communications range. In another example, the portable player drive can be a universal serial bus (USB) drive, which can be connected to a wagering game machine via a USB port. In another example, the portable player drive can be a player card. The player can swipe the card at, or insert the card into, a wagering game machine and store data on memory storage portions (e.g., an embedded memory chip) of the card. The wagering game machine can store the data via wireless or wired data transfer. The portable player drive can be secured so that it can be portable and can utilize encryption and decryption to store data, such as via the Rivest, Shamir, Adleman (RSA) algorithm.

The flow 300 continues at processing block 304, where the system authorizes the connection and prepares the portable player drive to record portable data from the wagering game network. The system can ensure, via an authorization procedure, that the portable player drive is a valid device that can store data from a wagering game machine or other casino devices.

The flow 300 continues at processing block 306, where the system determines a player preference regarding focus of recording portable data. In some embodiments, the focus can relate to specific types of data, priority of data, etc. In some embodiments, the system can read customized data settings or movements to capture focused data. The system can also provide controls and settings so that an individual (e.g., casino patron) can set priorities of what data to store and when. For example, FIG. 6 illustrates an example account that stores settings regarding data capture. FIG. 6 is an illustration of a wagering game system 600, according to some embodiments. In FIG. 6, an account server 670 is connected to a communications network 622. Also connected to the communications network 622 are a client device 660 and a portable player drive 640. The portable player drive 640 can be connected to the client device 660 (e.g., a home computer, a wagering game machine, a kiosk, a cell phone, etc.), or any other device that can communicate with the account server 670. In some embodiments, however, the portable player drive 640 may have capabilities to connect directly to the communications network 622 (e.g., via a wireless transmitter on the portable player drive 640). The account server 670 can include an account 601 (e.g. a player account, a patron account, a web account, etc.) that can store data capture priority settings 610 that indicate a priority for data capture on the portable player drive 640. For example, the portable player drive 640 may have limited time in which to capture data and/or limited resources (e.g., limited storage space, limited recording devices, limited access to recording devices, etc.). The account owner, however, may indicate within the data capture priority settings 610 what type of information is most important to the account owner, in hierarchical order, so that the portable player drive 640, or any device associated with the portable player drive 640 that may have capabilities to record data (e.g., the client device 660) can know what data to record first, with the highest quality, or in other ways afford recording prominence or importance.

The flow 300 continues at processing block 308, where the system stores portable data from the wagering game network according to the player preference. The system can store player specific data, wagering game data, environmental data, account data and other data available about the player experience in the wagering game network. In some embodiments, the system can store data on every game a player has ever played. In some embodiments, the system can store environment data that occurred in a casino. In some embodiments, the system can enable devices on the portable player drive (e.g., microphones to capture audio, a video camera to capture video, conductive head gear to capture voice, equipment to filter out ambient noise, etc.).

The flow 300 continues at processing block 310, where the system determines existing data on the portable player drive and customizes presentation of content in a wagering game session using the existing data. For example, the portable player drive may contain pre-configured player preference settings that indicate favorite game themes, backgrounds, settings, control configurations, display options, sound settings, multi-media files, etc. A wagering game machine can read the existing data and adapt how a wagering game environment appears, music that is played, game themes and/or graphics that are loaded, etc. In some embodiments, the existing data can refer to other accounts (e.g., associated accounts, friends, etc.). For example, in FIG. 6, the account 601 includes settings 604 related to social contacts that are associated with the account owner. The existing data on the portable player drive may include communication settings, identification information, contact information, competition game settings, etc. as related to the social contacts. The system can load the existing data into applications on the wagering game machine and use the data during a wagering game session.

The flow 300 continues at processing block 312, where the system determines a request to disconnect the portable player device from the wagering game network. The system may determine that a player account is about to terminate a wagering game session, has made a request to remove a portable player drive from a wagering game machine, has approached a far edge of a casino's wireless range, etc.

The flow 300 continues at processing block 314, where the system secures the portable data for transfer beyond the wagering game network. For example, the system can lock data stored on the portable player drive so that it cannot be read or modified until being unlocked via an authorized mechanism on another network (e.g., a home network) or by another device within the wagering game network or beyond. In some embodiments, the system can prepare the data for cross casino portability. For instance, the system can determine the a player is going to remove the portable player drive from a wagering game machine and secures the portable data with encryption, or other protection, so that it remains secure during transfer and can be decoded when accessed by other authorized devices, systems and/or networks external to the wagering game network. The player can then remove the portable player drive from casino property and take it, for example, to another casino property. The portable player drive, or devices associated with the portable player drive, can gather data from the other casino property, and from all other locations to which it is taken and used. The portable player drive can be like a data flight recorder for the player that gathers all kinds of environmental information. In some embodiments, the system can backup data from those devices to a long-term data storage (e.g., mirror, raid, etc.). In some embodiments, the system can interconnect with service networks (e.g., accounting/tax service networks, financial planning service networks, bank networks, auditing software, personal finance software, marketing services, etc.). In some embodiments, the system can secure the portable data as it is stored on the portable player drive, when the player indicates it wants to disconnect the portable player drive, after a player has disconnected a portable player drive, and/or at any other time.

The flow 300 continues at processing block 316, where the system uses the portable data on external devices, systems and/or networks. For instance, the system can send the portable data to a marketing server. In some embodiments, the system can analyze data/past history and determine what milestones are about to be met. The casino can mine that data and make offers to players based on play history, online data play, etc. In some embodiments, the system can download contacts from players to utilize in marketing. In some embodiments, the system can use the data for a neural network, such as to predict a player's activity or to tailor a wagering game session to the player's personal preference. For instance, the system can read player settings on the portable player drive to determine player likes, dislikes, etc., and use the player settings to tailor a gaming experience to the player's personal lifestyle. The portable player drive can carry over to home devices where the neural network can continue to do the above. In some embodiments, the system (e.g., via devices on a home network) system can use the portable data to replay an experience that occurred in a casino. For example, the portable player drive can contain sound and graphical data that can be played on audio and visual playback equipment at home.

Figure 4:
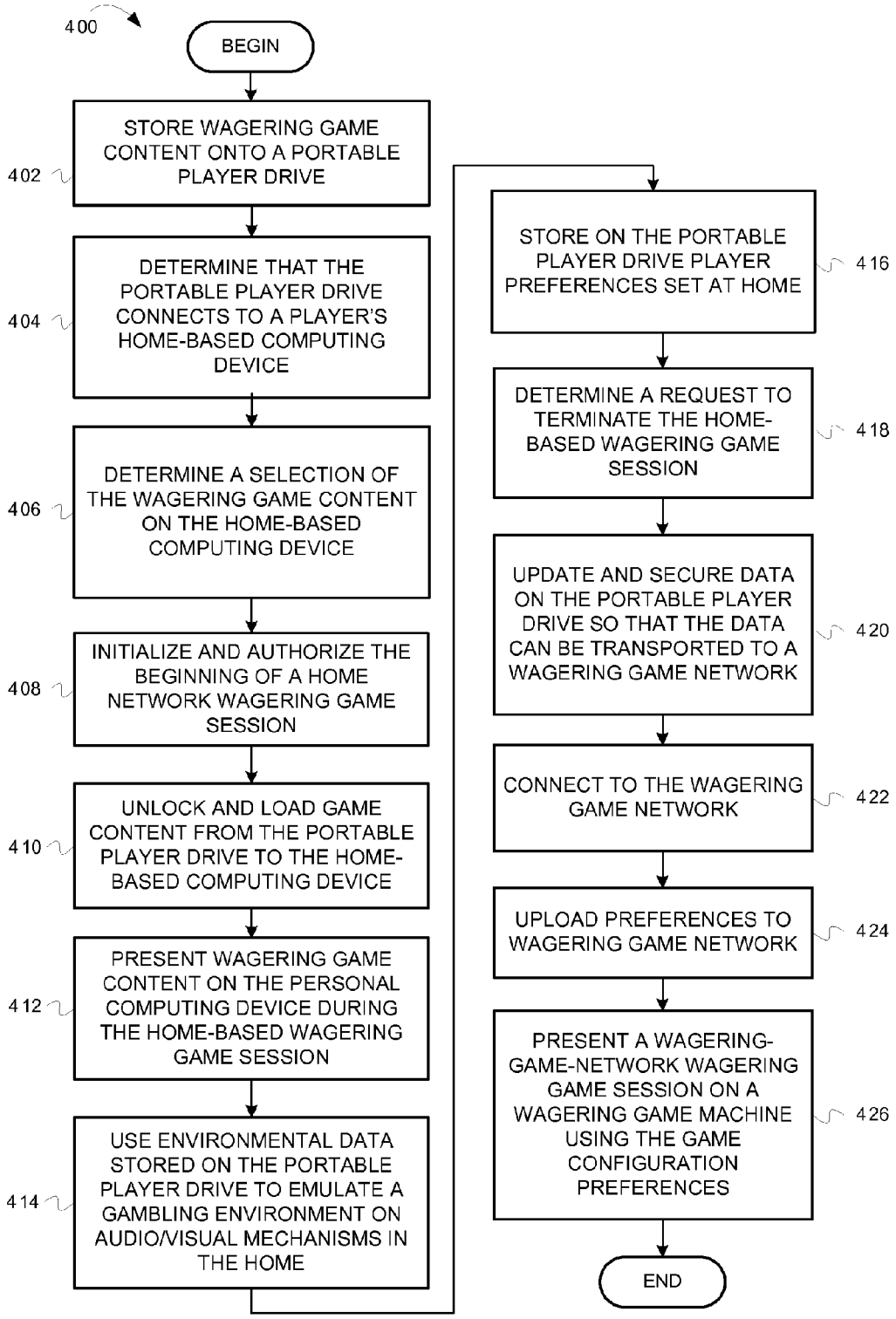
FIG. 4 is a flow diagram illustrating using portable wagering game data on a home wagering game network, according to some embodiments.

FIG. 4 is a flow diagram ("flow") 400 illustrating using portable wagering game data on a home wagering game network, according to some embodiments. In FIG. 4, the flow 400 begins at processing block 402, where a wagering game system ("system") stores wagering game content onto a portable player drive. The system can copy the wagering game content from a wagering game machine, from a wagering game server, from an online server, etc. In some embodiments, the system can store content for one or more wagering games on the portable player drive (e.g., content for games of a select theme, content for games that a player may like as predicted by the system, content for games that the player has not tried yet, content for a game that the player did not finish playing while in a casino, an entire game library by a game provider, etc.). In some embodiments, the system can sell or rent the game to a player account to store on the portable player drive.

The flow 400 continues at processing block 404, where the system determines that the portable player drive connects to a player's home-based computing device. The home-based computing device can be machine capable of processing wagering game content, for example, a personal computer, such as the personal computer 152 illustrated in FIG. 1. The personal computer can be connected to a home network, or other private localized network, such as a wireless or wired local area network (LAN) established in a player's personal residence. The home network can include a wireless router that connects to the Internet, or other communications network (e.g., a wide-area network, or "WAN"), via network access services provided by an Internet Service Provider (ISP). In some embodiments, the communications network can connect with wagering game servers, licensing servers, account server, etc., that can share data via the communications network. In other embodiments, however, the portable player drive can include game content, licensing information, account information, or any other information necessary to conduct wagering game sessions within the player's home, on the player's home-based computing device.

The flow 400 continues at processing block 406, where the system determines a selection of the wagering game content on the home-based computing device ("home computer"). A player may select a wagering game from a game console on a display of the home computer. The home computer can access the portable player drive for wagering game content.

The flow 400 continues at processing block 408, where the system initializes and authorizes the beginning of a home-based wagering game session. In some embodiments, the system can connect to an account server via a network connection to perform accounting activity (e.g., wagers, store wins, etc.). In other embodiments, however, the system can store accounting information on the portable player drive, in a secure format, and synchronize the data at a later time (see FIG. 5 below for examples of synchronizing data). In some embodiments, the system can connect to a wagering game server to determine control information (e.g., game determination, etc.), however, in some embodiments, the home computer can generate its own game determination. In some embodiments, the system can connect to a licensing server to determine authorization to play the game, yet in other embodiments, the portable player drive can store licensing information before it disconnects from a wagering game network so that the home computer can access it offline. In some embodiments, the system can connect to regulatory server to determine the geographic location of the home network (e.g., IP address tracking, GPS locating technology on device, etc.) and determine whether the wagering game can be played in the jurisdiction associated with the geographic location, and other regulatory guidelines.

The flow 400 continues at processing block 410, where the system unlocks and loads game content from the portable player drive to the home-based computing device. The home computer can decrypt data on the portable player drive that has been encrypted and present the data during a wagering game session. The portable player drive can be the authentication key/root of trust for home-based use. In some embodiments, the system can upload the wagering game content (e.g., applications), that are stored on the portable player drive to memory stores and caches (e.g., random access memory) on the home computer to improve performance. In some embodiments, the wagering game content can be stored on the portable player drive as a server-side application and the portable player drive can function as a secured server that streams, or otherwise delivers, data to the home computer securely without copying game assets to the home computer. A client-side player application on the home computer could play the streamed data. The portable player drive can include instructions that cause the home computer to generate a secured virtual drive on the home computer to perform server functions.

The flow 400 continues at processing block 412, where the system presents wagering game content on the portable computing device during a home-based wagering game session. In some embodiments, the home computer can present the wagering game content on a computer monitor connected to the home computer. In some embodiments, the system can create a competitive environment (e.g., can finish out registration for a tournament, can network with other players and compete in networked wagering games, etc.). In some embodiments, the home computer can access portable data that was stored while the portable player drive was in a wagering game network and present games that occurred within the casino. For example, the home computer can use the portable data to recreate and present games that the player had played or that others had played which were observed by recording equipment within a casino. The system could have stored game data on a game that a player had not finished while within the casino and which the home computer can present so that the player can play out the game that they started within the casino. In some embodiments, the home computer can also present other player's games as games that the player can play at home (e.g., games that the player saw someone else playing at the casino). Because the portable player drive can store vast amounts of data in a secure fashion, it can contain a game provider's entire library of games. The portable player drive can load neural network data onto the home computer, which the home computer can use to predict data, such as games from the library, which the player may like.

The flow 400 continues at processing block 414, where the system uses environmental data stored on the portable player drive to emulate a gambling environment on the audio/visual playback mechanisms in a home network. In some embodiments, the system can create a representation of the gambling environment via audio/visual mechanisms at home that are capable of using the data to create the representation of the gambling environment (e.g., sound from surround speaker system, ambient brightness of overhead lighting, virtual renditions on home computer of surroundings, interaction with home projection systems to project images on walls, etc.).

The flow 400 continues at processing block 416, where the system stores on the portable player drive player preferences set/made at home. The portable player drive can store game preferences, normally stored in a player account, which the home computer can access and/or modify during the home wagering game session. In some embodiments, the system can determine changes to game configurations made during the home-based wagering game session (e.g., can set favorite bank configurations, the game themes from another casino, the host data—e.g., to host a casino party). Devices in a casino can populate from that data when the portable player drive is reconnected to a wagering game network. In some embodiments, the system can determine data from activity performed in online casinos and use that data during the home wagering game session or during wagering game sessions in a wagering game network.

The flow 400 continues at processing block 418, where the system determines a request to terminate the home-based wagering game session. For example, a player may indicate, using the home computer, that the player has completed playing wagering games.

The flow 400 continues at processing block 420, where the system updates and secures data on the portable player drive so that the data can be transported to a wagering game network. The system can secure the data as it is stored during the home wagering game session and does not necessarily have to wait to do it all at once. However, at the end of a home wagering game session, the system can lock the portable player drive so that it is secured during transit (e.g., enable security modes that may destroy data if the portable player drive is tampered with during transit). The system can also enable security modes before the portable player drive is removed from a wagering game network to protect the data at all times while the portable player drive is beyond the wagering game network.

The flow 400 continues at processing block 422, where the system connects to the wagering game network. The system can verify that the portable player drive has been used properly and was not tampered with. The system can perform checks and verification procedures to ensure that the portable player drive is a valid authorized device that can connect to the wagering game network.

The flow 400 continues at processing block 424, where the system uploads the preferences to the wagering game network. For example, the system can upload preferences from the portable player drive to an account stored on an account server.

The flow 400 continues at processing block 426, where the system presents a wagering-game-network wagering game session on a wagering game machine using the game configuration preferences. For example, the system can utilize themes, graphics, music, etc. that the player has stored to play during wagering game session. The system can also utilize settings, such as bank configurations, so that the player and/or other players, can play group games or enjoy group settings (e.g., load backgrounds for the wagering game sessions that indicate a group's location on a bank of game machines, upload a unique identifier for the group, upload a group's contact list to detect when a group member had entered a casino and present a map of the current location in the casino of other group members from the list, etc.). The player can pre-configure all of the data at home in preparation for a group visit to the casino.

Figure 5:
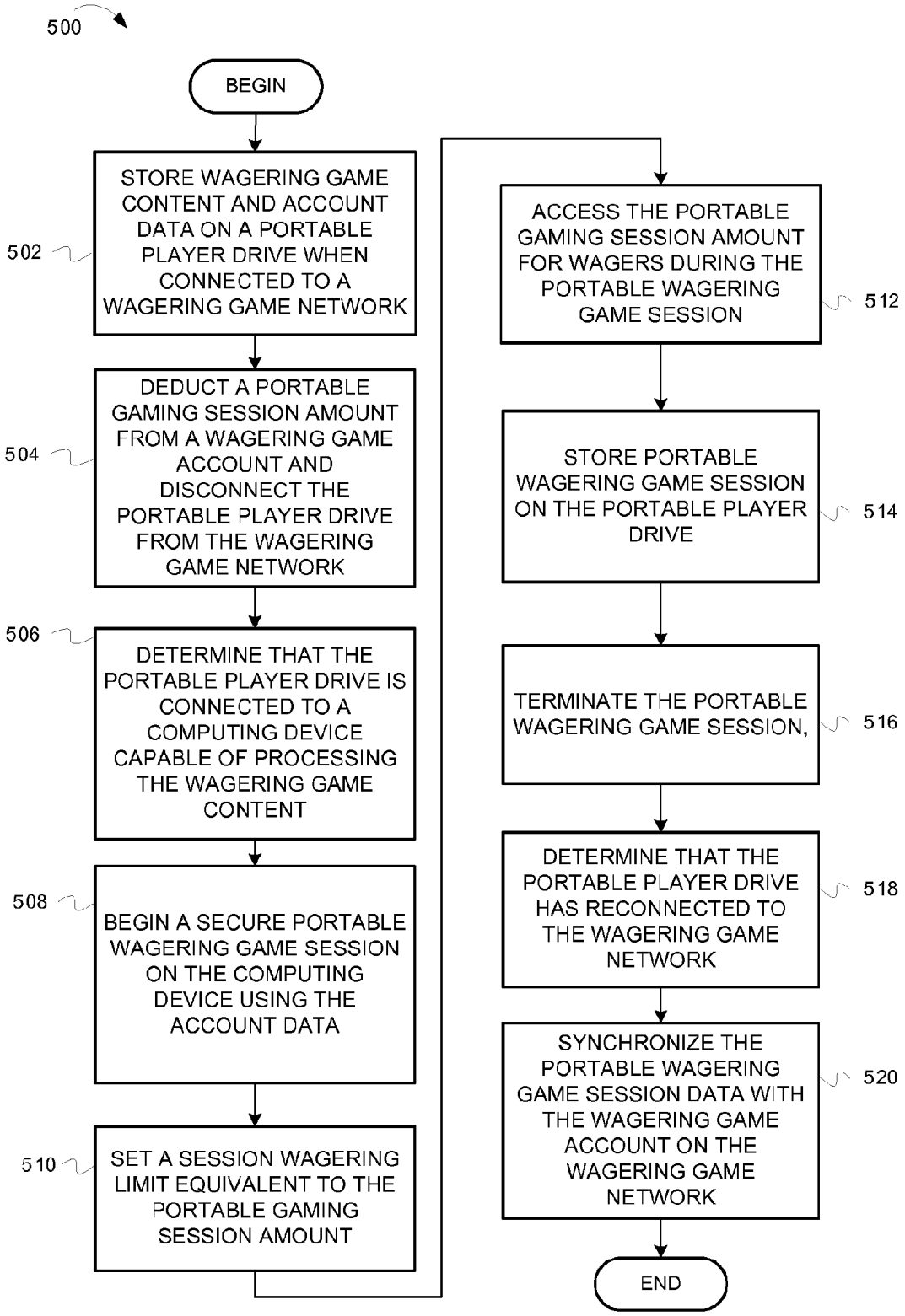
FIG. 5 is a flow diagram illustrating presenting portable wagering games sessions, according to some embodiments.

FIG. 5 is a flow diagram ("flow") 500 illustrating presenting portable wagering games sessions, according to some embodiments. In FIG. 5, the flow 500 begins at processing block 502, where a wagering game system ("system") stores game content and account data on a portable player drive when connected to a wagering game network. The account data can include an account balance from a wagering game account accessible from the wagering game network.

The flow 500 continues at processing block 504, where the system deducts a portable gaming session amount from a wagering game account and disconnects the portable player drive from the wagering game network. In some embodiments, the system can hold the portable gaming session amount in escrow on the account server. The portable gaming session amount can be a session spending limit. The session spending limit can be set as a precaution so that if the portable player drive is lost before synchronizing again, the system can consider the entire session spending limit as a loss. The system, however, transacts that amount up front as a loss and/or holds it in escrow as a loss, until the portable player drive can synchronize with the wagering game account and provide actual win/loss data from a portable wagering game session. The system can provide terms regarding the wagering game content and to the account data, which the player could to agree to before disconnecting from the wagering game network. In some embodiments, a player can store a setting that indicates, by default, how much money to deduct from the player account. In FIG. 6, the account 601 includes a portable gaming session setting 608 that indicates how much money should be deducted for an off-network gaming session. The system, however, can present controls that allow a player to change that amount when connected to the account 601, when disconnecting from the wagering game network, or at other times. Referring back to FIG. 5, the system can also determine whether the account can deduct the indicated amount. For example, the player may indicate an amount that exceeds the balance in the account and, therefore, the system can restrict the amount, suggest a different amount, provide controls for the player to augment the balance, offer a credit for the amount, etc.

The flow 500 continues at processing block 506, where the system determines that the portable player drive is connected to computing device external to the wagering game network capable of processing the game content. The computing device can be a personal computing device such as laptop, a personal computer, a cell phone, etc. that is external to the wagering game network. The computing device can also be a portable, or mobile, wagering game machine that a casino loans, assigns, sells, or otherwise provides, to the player for the player to take beyond the casino boundaries.

The flow 500 continues at processing block 508, where the system begins a secure portable wagering game session on the computing device using the account data. For example, the computing device can begin the secure portable wagering game session with the account balance that was determined before the player account disconnected from the wagering game network. The computing device can utilize the game content to present a game theme, game control elements, button panels, betting controls, etc.

The flow 500 continues at processing block 510, where the system sets a session wagering limit equivalent to the portable gaming session amount. The computing device can set a wagering limit for the session that only permits the player account to utilize wagers up to the amount held in escrow on the wagering game account back on the wagering game network. This can prevent, or at least limit, disputes between players and casinos as to lost data from the portable player device. This also encourages players to gamble responsibly by setting a spending limit. In some embodiments, the portable player device can store backup data and/or transport the backup data to backup devices (e.g., connect to and transport data via wireless wide-area networks when the portable player drive is in range to those wireless networks, download data to a portable cell phone, download data to a backup drive on the computing device, etc.).

The flow 500 continues at processing block 512, where the system accesses the portable gaming session amount for wagers during the portable wagering game session. In some embodiments, the system can set a beginning portable wagering game session account balance equal to the account balance. The system can modify the portable wagering game session account balance with wagers and wins that occur during the portable wagering game session. During the portable wagering game session, the computing device can perform outcome determination, control licensing, control account transactions, etc. For instance, using instructions stored on the portable player drive, the computing device can create a secure virtual drive or partition on the computing device that can perform secure functions. In other embodiments, the portable player drive can have an encrypted portion and/or a chip with a random number generator code that provides random numbers used to determine random wagering game outcomes. In some embodiments, the computing device can access the encrypted portion to obtain pre-stored random number. The portable player drive can provide a random number that the computing device can use to generate the wagering game outcome. The portable player drive can obtain a list of random numbers before disconnecting with the wagering game network. The system can encrypt the random numbers on the portable player drive and use them during the portable wagering game session. When the player makes a wager on a wagering game that the computing device presents, the computing device can deduct the wager amount from the portable wagering game session account balance. In some embodiments, the computing device can also deduct the wager amount from the session wagering limit, keeping it separate from the portable wagering game session account balance. The system thus can track the session wagering limit with each wager, thus reducing the amount from which the player can wager on subsequent wagers and ultimately limiting the amount wagers a player can make up to the amount in the session wagering limit. In some embodiments, however, the system can also add winnings that occur during the portable wagering game session to the session wagering limit so that the player can wager winnings earned during the portable wagering game session. Thus, the player would not be limited solely to the amount in escrow on the wagering game network but also to winnings that occurred during the portable wagering game session. In some embodiments, when a computing device determines that the player has depleted the session wagering limit, the system can continue to process wagering games using fake money. Thus, a player can continue to play wagering games for fun, not for wagering. In other embodiments, the system can accept a form of payment to continue processing wagering after the session wagering limit has been depleted. For example, if the computing device can connect to a wide-area network, the computing device can connect to the wagering game account on the wagering game network and can enter a credit card number and authorization to extract more money from the wagering game account on the wagering game network to add to the session wagering limit. The portable player device can track all the transactions as they occur. In some embodiments, the computing device can network with other computing devices and compete in networked wagering games.

The flow 500 continues at processing block 514, where the system stores portable wagering game session data on the portable player drive. The computing device can store as much data as possible during the portable wagering game session on the portable player drive. The computing device can store changes to the account data, game history information, and all other information that occurs during the portable wagering game session, on the portable player drive. The system can store the portable wagering game session account balance on the portable player drive as wagers and wins occur. The computing device can also record all environmental data, changes to game preferences, game settings and configurations, etc. that the player has indicated to record, and store them on the portable player drive.

The flow 500 continues at processing block 516, where the system terminates the portable wagering game session. The system can determine when a player account terminates a portable wagering game session. The system can secure the data for transfer to the wagering game network. The system can lock the data on the portable player device so that it cannot be changed until it is unlocked via an authorized mechanism. The system can determine a final portable wagering game session account balance and store it. Upon connecting with the wagering game account on the wagering game network, the system can synchronize the account balances.

The flow 500 continues at processing block 518, where the system determines that the portable player drive has reconnected to the wagering game network. A player can connect the portable player device to a wagering game network device, such as a wagering game machine, a kiosk, etc. If the player was using a mobile wagering game machine as the computing device during the portable wagering game session, the system can reconnect the mobile wagering game machine to the wireless wagering game network.

The flow 500 continues at processing block 520, where the system synchronizes the portable wagering game session data with wagering game account data on the wagering game network. The system can connect to the wagering game account on an account server and add credits won during the portable wagering game session, subtract wagers made during the portable wagering game session, and synchronize the account balance so that it matches the final portable wagering game session account balance. The system can also synchronize changes made to player preferences, game configurations, etc. on the wagering game account. The player account can then initiate a wagering game session within the wagering game network and continue using the updated account data, player preferences, game configurations, etc.

Additional Example Operating Environments

This section describes example operating environments, systems and networks, and presents structural aspects of some embodiments.

Wagering Game Machine Architecture

Figure 7:
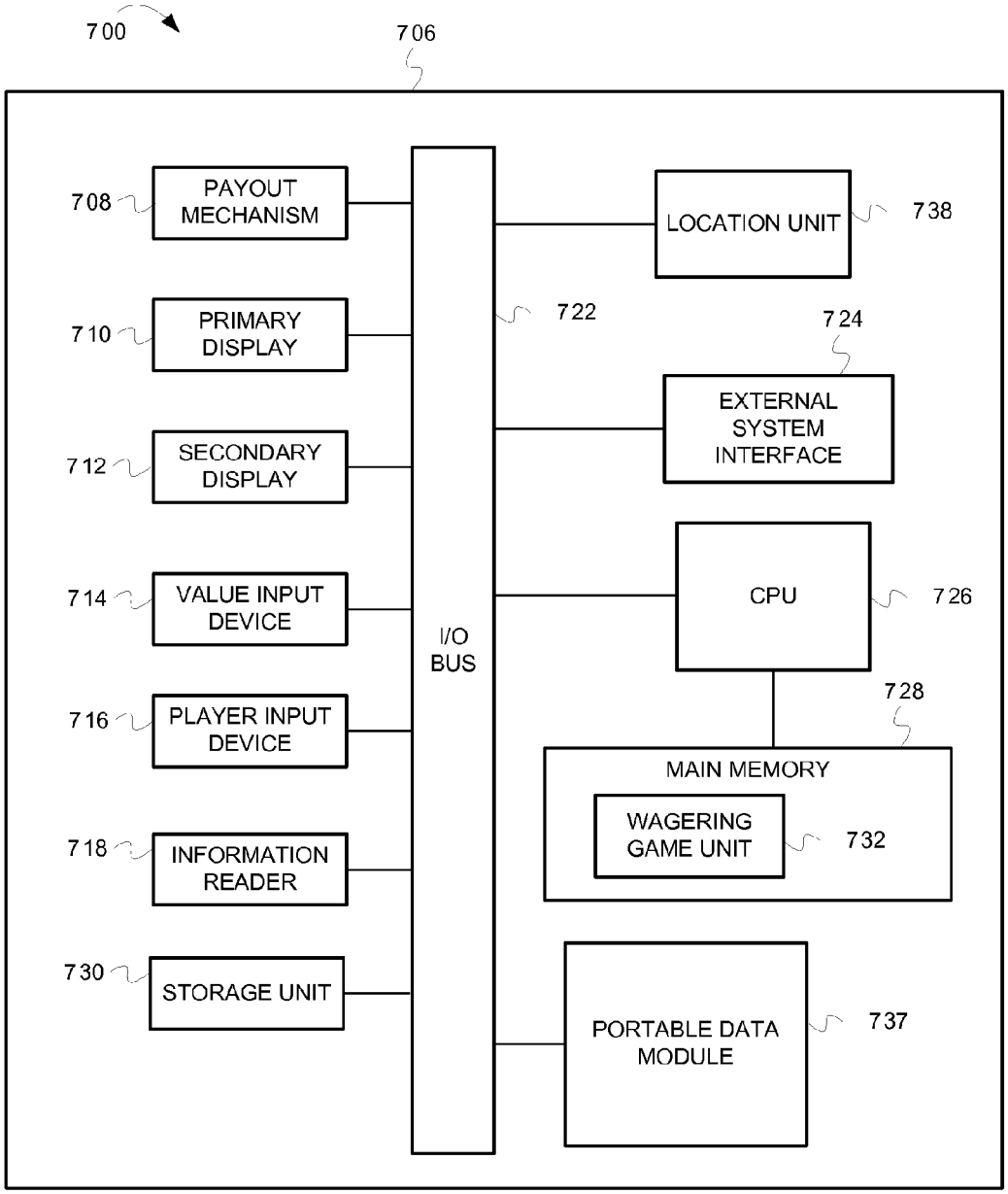
FIG. 7 is an illustration of a wagering game machine architecture 700, according to some embodiments.

FIG. 7 is a conceptual diagram that illustrates an example of a wagering game machine architecture 700, according to some embodiments. In FIG. 7, the wagering game machine architecture 700 includes a wagering game machine 706, which includes a central processing unit (CPU) 726 connected to main memory 728. The CPU 726 can include any suitable processor, such as an Intel® Pentium processor, Intel® Core 2 Duo processor, AMD Opteron™ processor, or UltraSPARC processor. The main memory 728 includes a wagering game unit 732. In some embodiments, the wagering game unit 732 can present wagering games, such as video poker, video black jack, video slots, video lottery, reel slots, etc., in whole or part.

The CPU 726 is also connected to an input/output ("I/O") bus 722, which can include any suitable bus technologies, such as an AGTL+ frontside bus and a PCI backside bus. The I/O bus 722 is connected to a payout mechanism 708, primary display 710, secondary display 712, value input device 714, player input device 716, information reader 718, and storage unit 730. The player input device 716 can include the value input device 714 to the extent the player input device 716 is used to place wagers. The I/O bus 722 is also connected to an external system interface 724, which is connected to external systems (e.g., wagering game networks). The external system interface 724 can include logic for exchanging information over wired and wireless networks (e.g., 802.11g transceiver, Bluetooth transceiver, Ethernet transceiver, etc.)

The I/O bus 722 is also connected to a location unit 738. The location unit 738 can create player information that indicates the wagering game machine's location/movements in a casino. In some embodiments, the location unit 738 includes a global positioning system (GPS) receiver that can determine the wagering game machine's location using GPS satellites. In other embodiments, the location unit 738 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 7, in some embodiments, the location unit 738 is not connected to the I/O bus 722.

In some embodiments, the wagering game machine 706 can include additional peripheral devices and/or more than one of each component shown in FIG. 7. For example, in some embodiments, the wagering game machine 706 can include multiple external system interfaces 724 and/or multiple CPUs 726. In some embodiments, any of the components can be integrated or subdivided.

In some embodiments, the wagering game machine 706 includes a portable data module 737. The portable data module 737 can process communications, commands, or other information, where the processing can transport and use wagering game data.

Furthermore, any component of the wagering game machine 706 can include hardware, firmware, and/or machine-readable media including instructions for performing the operations described herein.

Mobile Wagering Game Machine

Figure 8:
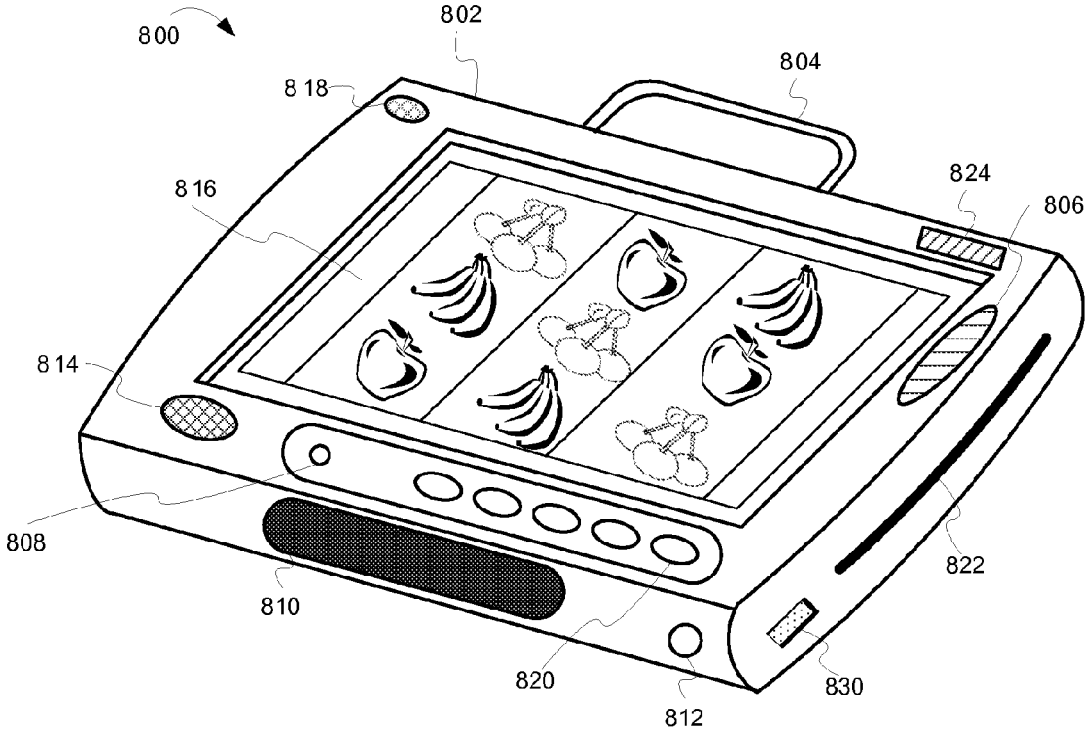
FIG. 8 is an illustration of a mobile wagering game machine 800, according to some embodiments.

FIG. 8 is a conceptual diagram that illustrates an example of a mobile wagering game machine 800, according to some embodiments. In FIG. 8, the mobile wagering game machine 800 includes a housing 802 for containing internal hardware and/or software such as that described above vis-à-vis FIG. 7. In some embodiments, the housing has a form factor similar to a tablet PC, while other embodiments have different form factors. For example, the mobile wagering game machine 800 can exhibit smaller form factors, similar to those associated with personal digital assistants. In some embodiments, a handle 804 is attached to the housing 802. Additionally, the housing can store a foldout stand 810, which can hold the mobile wagering game machine 800 upright or semi-upright on a table or other flat surface.

The mobile wagering game machine 800 includes several input/output devices. In particular, the mobile wagering game machine 800 includes buttons 820, audio jack 808, speaker 814, display 816, biometric device 806, wireless transmission devices (e.g., wireless communication units 812 and 824), microphone 818, and card reader 822. Additionally, the mobile wagering game machine can include tilt, orientation, ambient light, or other environmental sensors.

In some embodiments, the mobile wagering game machine 800 uses the biometric device 806 for authenticating players, whereas it uses the display 816 and the speaker 814 for presenting wagering game results and other information (e.g., credits, progressive jackpots, etc.). The mobile wagering game machine 800 can also present audio through the audio jack 808 or through a wireless link such as Bluetooth.

In some embodiments, the wireless communication unit 812 can include infrared wireless communications technology for receiving wagering game content while docked in a wager gaming station. The wireless communication unit 824 can include an 802.11G transceiver for connecting to and exchanging information with wireless access points. The wireless communication unit 824 can include a Bluetooth transceiver for exchanging information with other Bluetooth enabled devices.

In some embodiments, the mobile wagering game machine 800 is constructed from damage resistant materials, such as polymer plastics. Portions of the mobile wagering game machine 800 can be constructed from non-porous plastics which exhibit antimicrobial qualities. Also, the mobile wagering game machine 800 can be liquid resistant for easy cleaning and sanitization.

In some embodiments, the mobile wagering game machine 800 can also include an input/output ("I/O") port 830 for connecting directly to another device, such as to a peripheral device, a secondary mobile machine, etc. Furthermore, any component of the mobile wagering game machine 800 can include hardware, firmware, and/or machine-readable media including instructions for performing the operations described herein.

The described embodiments may be provided as a computer program product, or software, that may include a machine-readable medium having stored thereon instructions, which may be used to program a computer system (or other electronic device(s)) to perform a process according to embodiments(s), whether presently described or not, because every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. One or more non-transitory, machine-readable storage media having instructions stored thereon, which when executed by a set of one or more processors causes the set of one or more processors to perform operations comprising:

storing a wagering game application from a wagering game machine onto a portable data storage device connected to the wagering game machine, wherein the wagering game machine is connected to a wagering game network;

disconnecting the portable data storage device from the wagering game machine;

connecting the portable data storage device to a computing device that is not connected to the wagering game network, wherein the computing device is capable of processing the wagering game application;

detecting a selection of the wagering game application via user input from the computing device, wherein the selection of the wagering game application is during a wagering game session initiated on the computing device, and wherein the computing device is configured to present a wagering game via the wagering game application during the wagering game session in response to the selection of the wagering game application; and storing wagering game session data on the portable data storage device during the wagering game session.

2. The one or more non-transitory, machine readable storage media of claim 1, wherein the operation of storing the wagering game application includes operations comprising:

storing a wagering game library of applications of a wagering game provider on the portable data storage device from the wagering game machine; and presenting the wagering game application from the wagering game library.

3. The one or more non-transitory, machine readable storage media of claim 1, said operations further comprising:

detecting a payment to rent or buy the wagering game application; and storing the wagering game application from the wagering game machine onto the portable data storage device in response to detecting the payment.

4. The one or more non-transitory, machine readable storage media of claim 1, said operations further comprising:

using environmental data stored on the portable data storage device to emulate a gambling environment on playback mechanisms connected to the computing device.

5. The one or more non-transitory, machine-readable storage media of claim 1, said operations further comprising:

storing player preference data on the portable data storage device during the wagering game session;

determining that the wagering game session is terminated;

securing the wagering game session data and the player preference data on the portable data storage device;

connecting the portable data storage device to an additional wagering game machine;

initiating an additional wagering game session on the additional wagering game machine;

accessing the player preference data on the portable data storage device; and customizing a presentation of wagering game content on the additional wagering game machine during the additional wagering game session based on the player preference data.

6. The one or more non-transitory, machine readable storage media of claim 1, said operations further comprising:

determining that the wagering game session is terminated;

securing the wagering game session data on the portable data storage device;

connecting the portable data storage device to an additional wagering game machine connected the wagering game network;

providing the wagering game session data to the additional wagering game machine;

predicting a player's personal preference on the wagering game network using the wagering game session data; and tailoring an additional wagering game session on the additional wagering game machine to the player's personal preference.

7. The one or more non-transitory, machine-readable storage media of claim 1, said operations further comprising:

determining a geographic location of the computing device;

determining that the computing device is located within an authorized gambling jurisdiction associated with the geographic location; and authorizing the wagering game session in response to determining that the computing device is located within the authorized gambling jurisdiction.

8. An apparatus comprising:

one or more processors; and a portable data module configured to, via the one or more processors, deduct a first money value from a money balance of a wagering game account while a portable data storage device is connected to a machine that is connected to a wagering game network, wherein the machine has access to the wagering game account, store the first money value on the portable data storage device, disconnect the portable data storage device from the machine, connect the portable data storage device to a computing device external to the wagering game network, wherein the computing device is capable of processing the wagering game content, and wherein the computing device does not have access to the wagering game account, begin a wagering game session via the computing device using wagering game content, set a session wagering limit for the wagering game session equivalent to the first money value previously deducted from the wagering game account, detect wagering activity performed during the wagering game session via the computing device, and change the first money value to a second money value on the portable data storage device during the wagering game session in response to detecting the performing the wagering activity.

9. The apparatus of claim 8, wherein the portable data module is further configured to terminate the wagering game session, reconnect the portable data storage device to the machine connected to the wagering game network, and update the money balance of the wagering game account using the second money value.

10. The apparatus of claim 8, wherein the portable data module is further configured to subtract wagers from the first money value and add winnings to the first money value.

11. A system comprising:

one or more processors;

at least one communications device configured to communicate with a portable data storage device; and one or more memory storage units configured to store instructions, which when executed by at least one of the one or more processors, cause the system to perform operations to select, in response to user input, a wagering game application stored on the portable data storage device, wherein the portable data storage device is configured to communicate with a wagering game machine associated with a wagering game network during a first wagering game session and obtain the wagering game application from the wagering game machine, wherein the system is not associated with the wagering game network, and wherein the selection of the wagering game application occurs via a second wagering game session initiated via the system after the first wagering game session, present a wagering game for the second wagering game session in response to the selection of the wagering game application, and store wagering game session data, for the second wagering game session, on the portable data storage device.

12. The system of claim 11, wherein at least one of the one or more memory storage units is configured to store instructions, which when executed by at least one of the one or more processors, cause the system to further perform operations to access the wagering game application from a library of wagering game applications stored on the portable data storage device, wherein the library of wagering game applications are for a wagering game provider, and wherein the portable storage device is configured to attain the library of wagering game applications from the wagering game machine.

13. The system of claim 11, wherein at least one of the one or more memory storage units is configured to store instructions, which when executed by at least one of the one or more processors, cause the system to further perform operations to:

detect a payment to rent or buy the wagering game application; and transfer the wagering game application from the wagering game machine to the portable data storage device in response to detection of the payment.

14. The system of claim 11, wherein at least one of the one or more memory storage units is configured to store instructions, which when executed by at least one of the one or more processors, cause the system to further perform operations to:

use environmental data stored on the portable data storage device to emulate a gambling environment on playback mechanisms connected to the system.

15. The system of claim 11, wherein at least one of the one or more memory storage units is configured to store instructions, which when executed by at least one of the one or more processors, cause the system to further perform operations to:

store player preference data on the portable data storage device during the second wagering game session, wherein the player preference data is configured for use during a third wagering game session subsequent to the second wagering game session to customize a presentation of wagering game content.

16. The system of claim 11, wherein at least one of the one or more memory storage units is configured to store instructions, which when executed by at least one of the one or more processors, cause the system to further perform operations to store wagering game session data on the portable data storage device during the second wagering game session, wherein the wagering game session data is configured for use during a third wagering game session subsequent to the second wagering game session to predict a player preference.

17. The system of claim 11, wherein at least one of the one or more memory storage units is configured to store instructions, which when executed by at least one of the one or more processors, cause the system to further perform operations to determine, prior to use of the wagering game application for gambling in the second wagering game session, that the system is located in an authorized gambling jurisdiction.

18. A method comprising:

initiating a first wagering game session via a wagering game machine connected to a wagering game network;

connecting a portable data storage device to the wagering game machine;

accessing a wagering game application stored on the wagering game machine;

transferring, via at least one of one or more processors, the wagering game application from the wagering game machine to the portable data storage device during a first wagering game session; and disconnecting the portable data storage device from the wagering game machine, wherein portable data storage device is configured to, after termination of the first wagering game session, connect to a computing device that is not connected to the wagering game network, initiate a second wagering game session, access the wagering game application from the portable data storage device in response to user input, present a wagering game via use of the wagering game application, and store wagering game session data on the portable data storage device during the second wagering game session.

19. The method of claim 18 further comprising transferring a library of wagering game applications for a wagering game provider from the wagering game machine to the portable data storage device.

20. The method of claim 18 further comprising:

detecting a payment to rent or buy the wagering game application; and transferring the wagering game application from the wagering game machine to the portable data storage device in response to the detecting the payment.

21. The method of claim 18 further comprising:

storing environmental data on the portable data storage device, wherein the environmental data is for a gambling environment around the wagering game machine, wherein the computing device is configured to access the environmental data on the portable data storage device and emulate a gambling environment via playback mechanisms connected to the computing device.

22. The method of claim 18 further comprising:

storing player preference data on the portable data storage device during the first wagering game session, wherein the computing device is configured to access the player preference data from the portable data storage device during the second wagering game session and customize a presentation of wagering game content using the player preference data.

23. The method of claim 18 further comprising:

storing wagering game session data on the portable data storage device during the first wagering game session, wherein the wagering game session data is configured for use during the second wagering game session to predict a player preference.

24. The method of claim 18, wherein the computing device is configured to determine, prior to use of the wagering game application for gambling in the second wagering game session, that the computing device is located in an authorized gambling jurisdiction.

25. An apparatus comprising:

means for deducting a first money value from a money balance of a wagering game account while a portable data storage device is connected to a machine that is connected to a wagering game network, wherein the machine has access to the wagering game account;

means for storing the first money value on the portable data storage device; and means for disconnecting the portable data storage device from the machine, wherein the portable data storage device is configured to connect to a computing device external to the wagering game network that does not have access to the wagering game account, begin a wagering game session using the wagering game content, set a session wagering limit for the wagering game session equivalent to the first money value previously deducted from the wagering game account, detect wagering activity performed during the wagering game session via the computing device, and change the first money value to a second money value on the portable data storage device during the wagering game session in response to the wagering activity.

26. The apparatus of claim 25 further comprising:

means for reconnecting the portable data storage device to the machine connected to the wagering game network after the wagering game session, and means for updating the money balance of the wagering game account using the second money value.

27. The apparatus of claim 25, wherein the computing device is configured to one or more of subtract wagers from the first money value and add winnings to the first money value during the wagering game session.

28. An apparatus comprising:

means for deducting a first money value from a money balance of a wagering game account while a portable data storage device is connected to a machine that is connected to a wagering game network, wherein the machine has access to the wagering game account;

means for storing the first money value on the portable data storage device for use in a wagering game session on a computing device external to the wagering game network, wherein the computing device does not have access to the wagering game account; and means for disconnecting the portable data storage device from the machine, wherein the portable data storage device is configured to connect to the computing device, and wherein the computing device is configured to begin a wagering game session using the wagering game content, set a session wagering limit for the wagering game session equivalent to the first money value previously deducted from the wagering game account, detect wagering activity performed during the wagering game session, and change the first money value to a second money value on the portable data storage device during the wagering game session in response to the wagering activity.

29. The apparatus of claim 28 further comprising:

means for reconnecting the portable data storage device to the machine connected to the wagering game network after the wagering game session, and means for updating the money balance of the wagering game account using the second money value.

30. The apparatus of claim 28, wherein the computing device is configured to one or more of subtract wagers from the first money value and add winnings to the first money value during the wagering game session.

31. One or more non-transitory, machine-readable storage media having instructions stored thereon, which when executed by a set of one or more processors causes the set of one or more processors to perform operations comprising:

initiating a communication link between a portable data storage device and a computing device that is not connected to a wagering game network, wherein the portable data storage device includes a first money value that was deducted from a money balance of a wagering game account while the portable data storage device was connected to a machine connected to the wagering game network;

initiating a wagering game session via the computing device;

setting a session wagering limit for the wagering game session equivalent to the first money value;

detecting wagering activity performed during the wagering game session; and changing the first money value to a second money value on the portable data storage device during the wagering game session in response to the wagering activity.

32. The one or more non-transitory, machine-readable storage media of claim 31, said operations further comprising:

terminating the wagering game session; and terminating the communication link between the portable data storage device and the computing device, wherein the portable data storage device includes the second money value after the communication link is terminated, wherein the portable data storage device is configured to connect to one of more wagering game machines connected to the wagering game network, wherein the wagering game account is accessible via the wagering game network, and wherein the money balance of the wagering game account is configured to update the money balance using the second money value.

33. The one or more non-transitory, machine-readable storage media of claim 31, said operations further comprising one or more of subtracting wagers from the first money value and adding winnings to the first money value during the wagering game session.

* * * * *